US007954914B2

(12) United States Patent
Kendall et al.

(10) Patent No.: US 7,954,914 B2
(45) Date of Patent: Jun. 7, 2011

(54) RETRACTABLE HANGING ELEMENT

(75) Inventors: James William Kendall, Stevensville, MI (US); Lorraine L. Achterberg, St. Joseph, MI (US); Raymond L. Yao, St. Joseph, MI (US); Vicki Lyn Wyatt, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1085 days.

(21) Appl. No.: 11/322,503

(22) Filed: Dec. 30, 2005

(65) Prior Publication Data

US 2007/0152550 A1 Jul. 5, 2007

(51) Int. Cl.
*A47B 88/00* (2006.01)
*A47B 95/02* (2006.01)
*A47B 81/00* (2006.01)

(52) U.S. Cl. ..... 312/330.1; 312/228.1; 312/319.1

(58) Field of Classification Search ..... 312/282, 312/21, 131, 132, 319.1–319.4; 211/1.3, 211/94, 94.5, 105.3, 123; 248/251, 221, 248/252, 257
See application file for complete search history.

(56) References Cited

U.S. PATENT DOCUMENTS

| | | | | |
|---|---|---|---|---|
| 380,949 | A | 4/1888 | Shannon | |
| 405,630 | A * | 6/1889 | Vardon | 312/128 |
| 970,174 | A | 9/1910 | Booton | |
| 1,000,933 | A | 8/1911 | North | |
| 1,369,933 | A | 3/1921 | Nelson | |
| 2,202,811 | A | 6/1940 | Carney et al. | |
| 2,230,793 | A | 2/1941 | Borah | |
| 2,355,835 | A | 8/1944 | Whalen | |
| 2,463,218 | A | 3/1949 | Travis | |
| 2,576,067 | A | 11/1951 | Chandler | |
| 2,587,111 | A | 2/1952 | Cashen | |
| 2,778,705 | A | 1/1957 | Barker | |
| 2,895,618 | A | 7/1959 | Nathan | |
| 2,983,050 | A | 5/1961 | Alaback | |
| 3,086,657 | A | 4/1963 | Myers et al. | |
| 3,197,886 | A | 8/1965 | Brame et al. | |
| 3,376,088 | A * | 4/1968 | Bol et al. | 292/353 |

(Continued)

FOREIGN PATENT DOCUMENTS

| | | |
|---|---|---|
| DE | 662984 | 7/1938 |

(Continued)

OTHER PUBLICATIONS www.canadianwoodcraftsman.com/kitchen/insetdoorsanddrawers.html, Frederick J. Miller, Nov. 30, 2004.*

(Continued)

*Primary Examiner* — Darnell M Jayne
*Assistant Examiner* — Timothy M Ayres
(74) *Attorney, Agent, or Firm* — Clifton G. Green; McGarry Bair P.C.

(57) ABSTRACT

A household consumer product comprises a cabinet having a peripheral wall that partially defines an interior space for the cabinet and includes an opening that provides access to the interior space. A hanging element having a proximal end is mounted to the cabinet for movement through the opening between an extended position, where the proximal end extends beyond the peripheral wall, and a retracted position, where the proximal end does not extend beyond the peripheral wall. The hanging element can include a biasing device that biases the hanging element from the retracted position toward the extended position.

16 Claims, 19 Drawing Sheets

U.S. PATENT DOCUMENTS

| | | | | | |
|---|---|---|---|---|---|
| 3,399,783 | A | | 9/1968 | Injeski | |
| 3,527,352 | A | | 9/1970 | Lapa | |
| 3,739,496 | A | | 6/1973 | Buckley et al. | |
| 3,854,785 | A | * | 12/1974 | Manner et al. | 312/319.1 |
| 3,866,336 | A | | 2/1975 | Bereza | |
| 3,926,315 | A | | 12/1975 | Bernard | |
| 3,981,404 | A | | 9/1976 | Goeke | |
| 4,086,709 | A | | 5/1978 | Jackson | |
| 4,094,414 | A | | 6/1978 | Thiot et al. | |
| D251,165 | S | | 2/1979 | Moody | |
| 4,180,919 | A | | 1/1980 | Baltes | |
| 4,625,432 | A | | 12/1986 | Baltes | |
| 4,640,200 | A | * | 2/1987 | Richardson | 109/19 |
| 4,760,929 | A | | 8/1988 | Fedorchak | |
| 4,901,871 | A | | 2/1990 | Ohm et al. | |
| 4,919,368 | A | | 4/1990 | Garrett | |
| 5,019,126 | A | | 5/1991 | Post | |
| 5,040,833 | A | * | 8/1991 | Brunnert | 292/80 |
| 5,046,844 | A | | 9/1991 | Milton | |
| 5,181,685 | A | | 1/1993 | Ostapowicz | |
| 5,337,905 | A | | 8/1994 | Gast | |
| 5,411,164 | A | | 5/1995 | Smith et al. | |
| 5,555,640 | A | | 9/1996 | Ou | |
| 5,702,010 | A | | 12/1997 | Liang | |
| 5,755,040 | A | | 5/1998 | Ou | |
| 5,836,486 | A | | 11/1998 | Ohsugi | |
| 5,967,342 | A | | 10/1999 | Steffine | |
| 7,152,892 | B2 | * | 12/2006 | Rechberg | 292/304 |
| 2002/0017117 | A1 | | 2/2002 | Sunshine et al. | |
| 2002/0124779 | A1 | * | 9/2002 | Perkins | 109/47 |
| 2004/0119297 | A1 | * | 6/2004 | Bella et al. | 292/300 |
| 2004/0134237 | A1 | | 7/2004 | Sunshine et al. | |
| 2005/0035076 | A1 | | 2/2005 | Schober et al. | |
| 2007/0216169 | A1 | * | 9/2007 | Jackson et al. | 292/169 |

FOREIGN PATENT DOCUMENTS

| | | | |
|---|---|---|---|
| DE | 3211316 | | 9/1983 |
| DE | 9104422 | | 7/1991 |
| DE | 4105112 | | 8/1992 |
| DE | 4228469 | | 5/1993 |
| DE | 19922647 | | 11/2000 |
| DE | 10223539 | | 12/2003 |
| EP | 1146161 | A1 | 4/2000 |
| EP | 1227182 | | 7/2002 |
| GB | 617965 | | 2/1949 |
| GB | 2164552 | | 3/1986 |
| JP | 07213792 | | 8/1995 |
| JP | 09149826 | | 6/1997 |
| JP | 2000218093 | | 8/2000 |
| JP | 2002000997 | | 1/2002 |
| JP | 2002126395 | | 5/2002 |
| JP | 2002233693 | | 8/2002 |
| JP | 2003114611 | | 4/2003 |
| JP | 2003311097 | | 11/2003 |
| KR | 200201898 | | 11/2000 |
| KR | 1020040009401 | | 1/2004 |
| WO | 03035961 | | 5/2003 |

OTHER PUBLICATIONS

NPL: Better Lifestyle Products; Rolling Mobile Laundry Ironing Center; Jul. 28, 2005; http://www.betterlifestyleproducts.com/mobile-laundry-center.html.

NPL: Bosch; Bosch Laundry Vertical Stacking Kit with Pull-Out Tray; Jul. 26, 2006; http://www.bosch appliances.com/customer_care/1492_423.asp.

NPL: Thor Appliance Company; Washing Machine—APEX by Thor; Jul. 26, 2005 http://thorappliances.com/apex/index.php, http://thorappliances.com/apex/images/apexzoom2.jpg, http://thorappliances.com/apex/apexAnatomy.php.

* cited by examiner

RETRACTABLE HANGING ELEMENT

BACKGROUND OF THE INVENTION

1. Field of the Invention

The invention relates to a household consumer product, such as a laundry appliance, with a retractable hanging element.

2. Description of the Related Art

The process of laundry care can include several steps, such as washing, drying, ironing, steaming, refreshing, and the like. Some of these steps are conducted in the laundry area, and others are performed outside the laundry area. Regardless, it is convenient to have a place to hang the clothing items before, during, and after these steps. Some people hang the clothing items on doorknobs, over the top of the door, on a separate hanging rack, or on other similar locations. However, some of the hanging locations are not meant for this purpose, and the clothing items are often not securely hung and tend to undesirably fall to the ground. The separate hanging racks are intended to be used for hanging, but they tend to be cumbersome, are inconvenient to store when not in use, and not dimensioned to optimize the space of the laundry area or other location where the laundry care is performed.

In an attempt to provide a hanging solution that does not require a significant amount of space, some hanging elements have been mounted to a laundry appliance, such as a conventional washing machine or dryer. Hanging elements mounted to the exterior of the laundry appliance, however, can be unsightly when not in use or difficult to manipulate between stored and use positions. Other hanging elements have been designed so as to slidably retract into the laundry appliance when not in use and slidably extend out of the laundry appliance when the hanging element is needed for hanging the clothing items. Even these hanging elements have disadvantages. For example, when the hanging element is slid to the retracted position, a proximal end of the hanging element must at least partially project from the laundry appliance so that the user can grasp the hanging element and pull it to the extended position. As a result, a user can accidentally bump into the hanging element when in the retracted position and thereby injure themselves and/or pull the hanging element further from the laundry appliance.

SUMMARY OF THE INVENTION

The invention relates to a household consumer product having a cabinet and a hanging rod moveable with respect to the cabinet.

The proximal end of the hanging element can be flush with the peripheral wall when in the retracted position.

The peripheral wall can have an outer surface, and when the hanging element is in the retracted position, the proximal end of the hanging element can be one of flush with the peripheral wall outer surface and positioned distally of the peripheral wall outer surface.

The household consumer product can further comprise a biasing element that biases the hanging element from the retracted position toward the extended position. The biasing element can be a spring. The household consumer product can further comprise an actuator that is coupled to the hanging element and controls operation of the biasing element. The actuator can be a push-push actuator.

The peripheral wall can comprises a front wall, and the opening can be formed in the front wall.

The hanging element can comprise a rod. The rod can comprise a distal portion and a proximal portion pivotally mounted to the distal portion.

The hanging element can comprise at least one of a U-shaped bar and a T-shaped bar.

The household consumer product can be a laundry appliance.

The hanging element can be mounted to the cabinet for sliding movement between the extended and retracted positions.

A household consumer product according to another embodiment of the invention comprises a cabinet having a peripheral wall that partially defines an interior space for the cabinet and includes an opening that provides access to the interior space. a hanging element mounted to the cabinet for movement through the opening between an extended position for hanging items on the hanging element and a retracted position for storage, and a biasing element that biases the hanging element from the retracted position toward the extended position.

A proximal end of the hanging element can be flush with the peripheral wall when in the retracted position.

The peripheral wall can have an outer surface, and when the hanging element is in the retracted position, a proximal end of the hanging element can be one of flush with the peripheral wall outer surface and positioned distally of the peripheral wall outer surface.

The biasing element can be a spring.

The household consumer product can further comprise an actuator that is coupled to the hanging element and controls operation of the biasing element. The actuator can be a push-push actuator.

The peripheral wall can comprise a front wall, and the opening can be formed in the front wall.

The hanging element can comprise a rod. The rod can comprise a distal portion and a proximal portion pivotally mounted to the distal portion.

The hanging element can comprise at least one of a U-shaped bar and a T-shaped bar.

The household consumer product can be a laundry appliance.

The hanging element can be mounted to the cabinet for sliding movement between the extended and retracted positions.

DESCRIPTION OF EMBODIMENTS OF THE INVENTION

Figure 2:
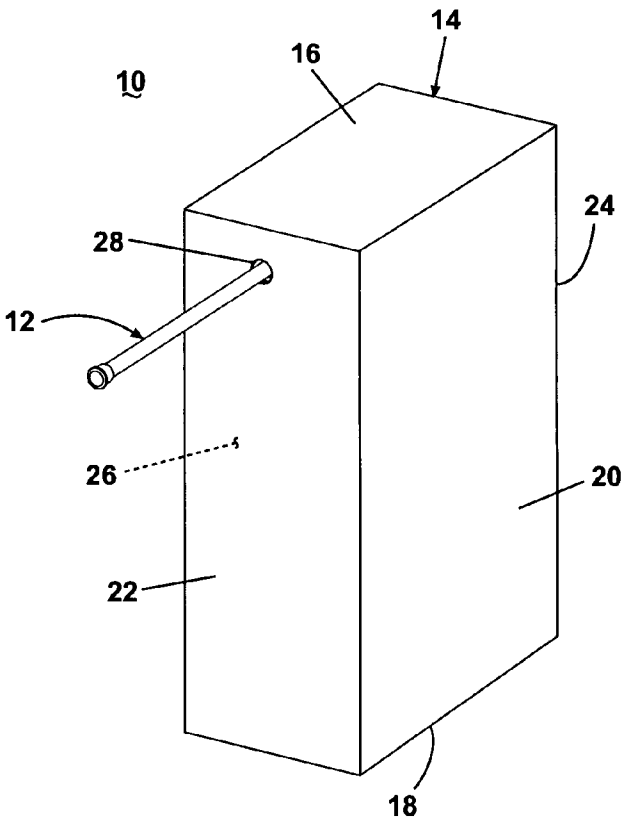
FIG. 2 is a schematic view similar to FIG. 1, wherein the hanging element is shown in an extended position.
Figure 1:
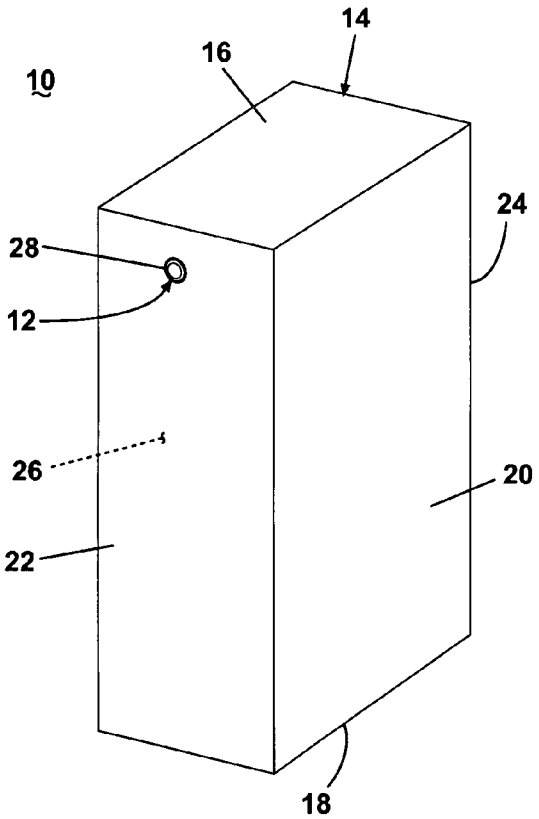
FIG. 1 is a schematic view of a household consumer product having a hanging element according to one embodiment of the invention, wherein the hanging element is shown in a retracted position.

Referring now to the drawings, FIGS. 1 and 2 illustrate a household consumer product 10 comprising a hanging element 12 according to one embodiment of the invention. The household consumer product 10 can be any suitable consumer product, including, but not limited to, a laundry appliance, such as a washing machine, a dryer, a combination washing machine and dryer, or a non-aqueous non-aqueous washing apparatus. An exemplary non-aqueous washing apparatus is disclosed in U.S. Patent Application Publication No. 2005/0155393, which is incorporated herein by reference in its entirety. The non-aqueous washing apparatus of the incorporated application publication comprises a wash unit and a reclamation unit, and the household consumer product 10 can be the wash unit or the reclamation unit.

Another example of the household consumer product 10 is a module of a modular laundry system, such as disclosed in application Ser. No. 11/323,125, filed concurrently herewith, and titled "Modular Laundry System with Horizontal Modules," application Ser. No. 11,322,715, filed concurrently herewith, and titled "Modular Laundry System with Horizontal Module Spanning Two Laundry Appliances," application Ser. No. 11,323,221, filed concurrently herewith, and titled "Modular Laundry System with Horizontally Arranged Cabinet Module," application Ser. No. 11,322,739, filed concurrently herewith, and titled "Modular Laundry System with Horizontal and Vertical Modules," application Ser. No. 11/323,075, filed concurrently herewith, and titled "Modular Laundry System with Vertical Module," application Ser. No. 11/323,147, filed concurrently herewith, and titled "Modular Laundry System with Cabinet Module," and application Ser. No. 11/322,742, filed concurrently herewith, and titled "Laundry Module for Modular Laundry System," which are incorporated herein by reference in their entirety. Other exemplary modules are disclosed in application Ser. No. 11/323,867, filed concurrently herewith, and titled "Vertical Laundry Module," application Ser. No. 11/322,943, filed concurrently herewith, and titled "Vertical Laundry Module with Backsplash," application Ser. No. 11/322,502, filed concurrently herewith, and titled "Non-Tumble Clothes Dryer," application Ser. No. 11/323,270, filed concurrently herewith, and titled "Ironing Station," and application Ser. No. 11/322,944, filed concurrently herewith, and titled "Sink Station with Cover," which are incorporated herein by reference in their entirety.

Another example of the household consumer product 10 is a worksurface for a modular laundry system, and exemplary work surfaces are disclosed in the above-incorporated modular laundry system applications as well as in application Ser. No. 11/323,220, filed concurrently herewith, and titled "Modular Laundry System with Work Surface," application Ser. No. 11/322,773, filed concurrently herewith, and titled "Modular Laundry System with Segmented Work Surface," application Ser. No. 11/322,741, filed concurrently herewith, and titled "Modular Laundry System with Work Surface Having a Functional Insert," application Ser. No. 11/322,740, filed concurrently herewith, and titled "Modular Laundry System with Work Surface Having a Functional Element," and application Ser. No. 11/323,658, filed concurrently herewith, and titled "Modular Laundry System with Shelf Module," which are incorporated herein by reference in their entirety.

The household consumer product 10 comprises a cabinet 14 having spaced top and bottom walls 16, 18 joined by a peripheral wall having a pair of opposed side walls 20, a front wall 22, and a rear wall 24. Each of the walls of the cabinet 14 has an outer surface. The peripheral wall is not limited to a rectangular configuration, as shown in FIGS. 1 and 2. Rather, the peripheral wall can have any suitable configuration, such as oval, circular, square, trapezoidal, or irregular. The cabinet 14 defines an interior space 26 of the household consumer product 10, and one of the walls, such as the front wall 22 according to the illustrated embodiment, includes an opening 28 that provides access to the interior space 26 from the exterior of the household consumer product 10.

The hanging element 12 is slidably mounted to the cabinet 14 such that it is movable from a retracted, storage position, as shown in FIG. 1, to an extended, use position, as illustrated in FIG. 2, where clothing items can be hung on the hanging element 12, such as with a hanger or by draping the clothing item on the hanging element 12. The retracted and extended positions of the hanging element 12 are further described below.

Figure 3:
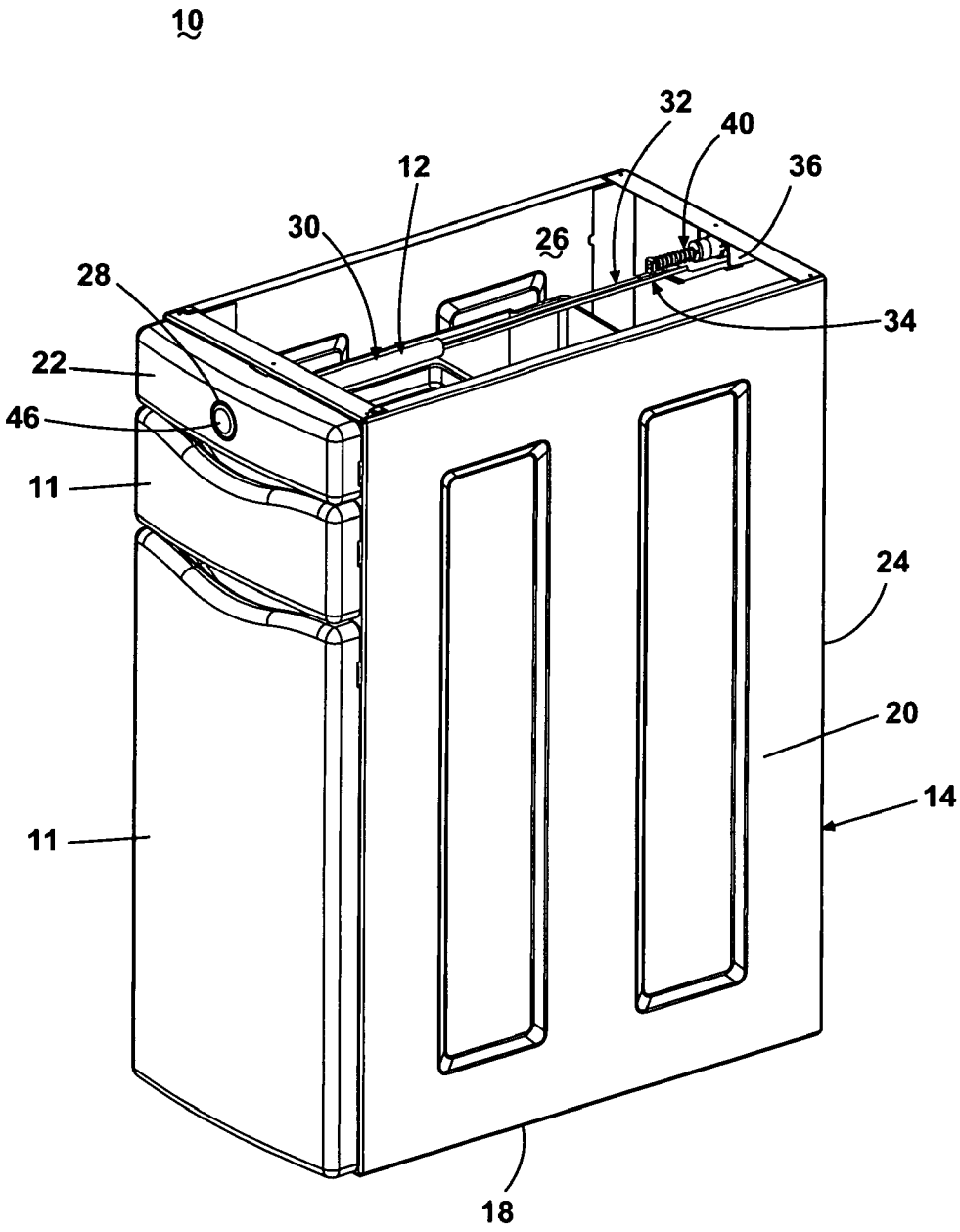
FIG. 3 is a perspective view of a household consumer product in the form of a storage module with a top wall removed and having a hanging element according to another embodiment of the invention, wherein the hanging element is shown in the retracted position.
Figure 4:
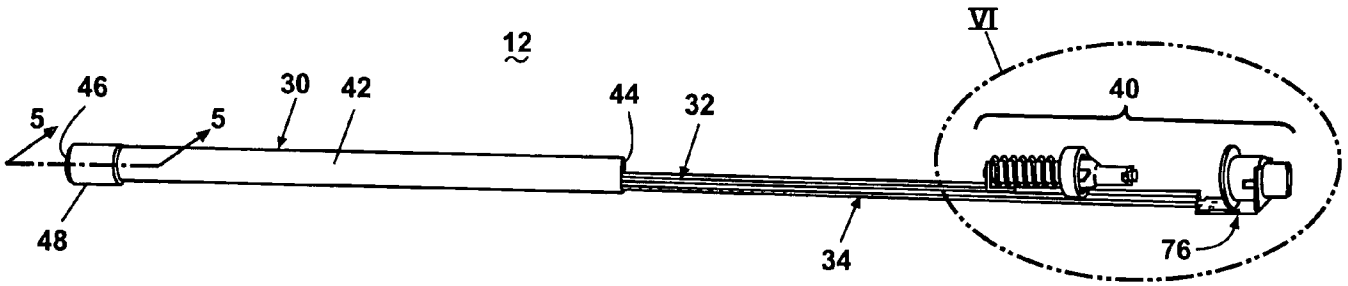
FIG. 4 is a perspective view of the hanging element of FIG. 3.

Referring now to FIG. 3, one embodiment of the hanging element 12 is illustrated as mounted within the household consumer product 10 in the form of a storage module having a plurality of storage drawers 11. Referring additionally to FIG. 4, the hanging element 12 comprises a hanging rod 30 fixedly mounted to a slide 32, which is slidably mounted to a stationary track 34. The stationary track 34 is mounted between proximal and distal brackets 36 (the proximal bracket is not shown in the figures) that mount the hanging element 12 to the cabinet 14. An actuator 40 partially mounted to the slide 32 and partially mounted to the track 34 facilitates movement of the hanging element 12 from the retracted position toward the extended position, as will be described in more detail below.

Figure 5:
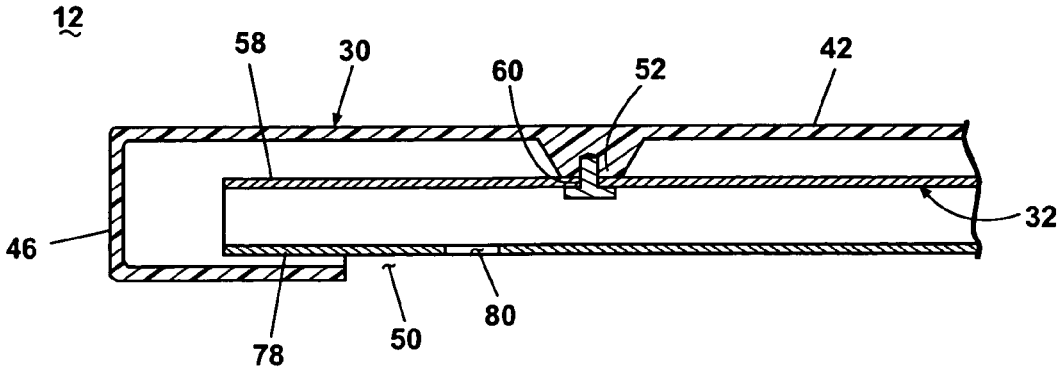
FIG. 5 is a sectional view taken along line 5-5 of FIG. 4.

With continued reference to FIG. 4, the hanging rod 30 comprises a hollow, generally cylindrical body 42 open at a distal end 44 and closed at a proximal end 46 by a cap 48. Additionally, as best seen in FIG. 5, the hanging rod 30 includes a slot 50 formed along a lower portion of the body 42 from the distal end 44 to near the proximal end 46. The slot 50 is spaced from the cap 48 by a predetermined distance so that the proximal end 46 of the hanging rod 30 is fully cylindrical. The hanging rod 30 further includes an internal mounting boss 52 located near the proximal end 46 and opposite the slot 50. The hanging rod 30 can have any suitable length, and the hanging rod 30 in the illustrated embodiment has a length equal to about half the depth of the cabinet 14, wherein the depth is measured as the distance between the front and rear walls 22, 24.

Figure 6:
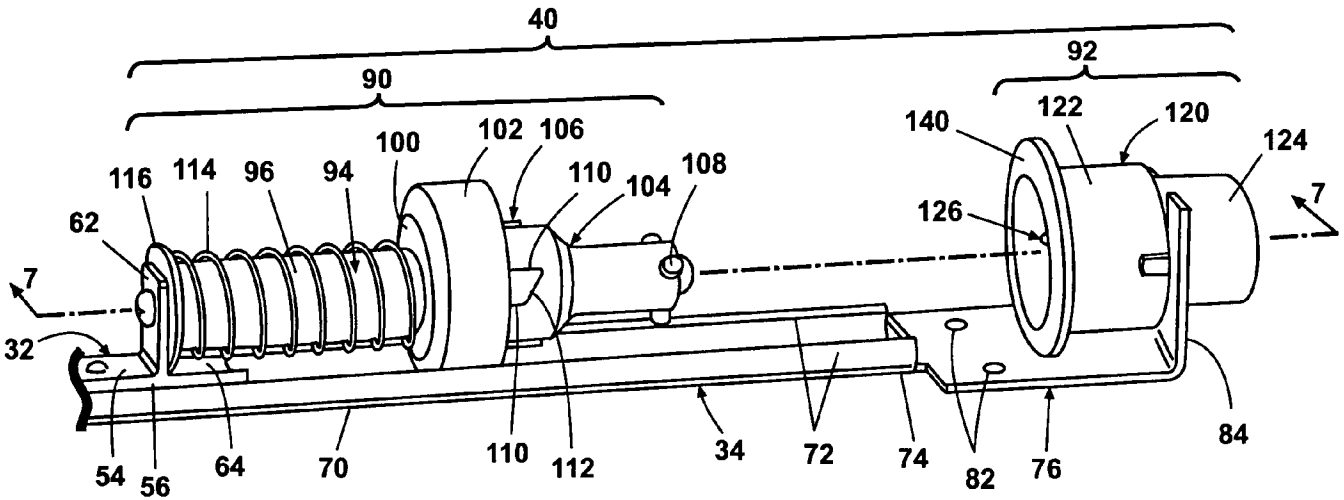
FIG. 6 is an enlarged view of the region labeled VI in FIG. 5.

Referring now to FIGS. 4 and 6, the slide 32 comprises an elongated body 54 having depending side rails 56. As shown in FIG. 5, near a proximal end 58, the slide 32 has an aperture 60 sized to receive a fastener, such as a screw, for fixedly mounting the slide 32 to the internal mounting boss 52 of the hanging rod 30. As best viewed in FIG. 6, the slide 32 further comprises an upwardly extending flange 62 near a distal end 64 for mounting a portion of the actuator 40 to the slide 32.

The track 34 comprises an elongated body 70 with upwardly extending side rails 72 spaced from one another for slidingly receiving the side rails 56 of the slide 32. As shown in FIGS. 5 and 6, the track 34 has a distal end 74 that terminates at a distal mount 76 and a proximal end 78, near which is formed an aperture 80 sized to receive a fastener for mounting the track 34 to the proximal bracket 36. The distal mount 76 is a generally planar structure that includes apertures 82 sized to receive fasteners for mounting the distal mount 76 to the distal. bracket 36. The distal mount 76 terminates at an upwardly extending flange 84 adapted to support a portion of the actuator 40.

Figure 7:
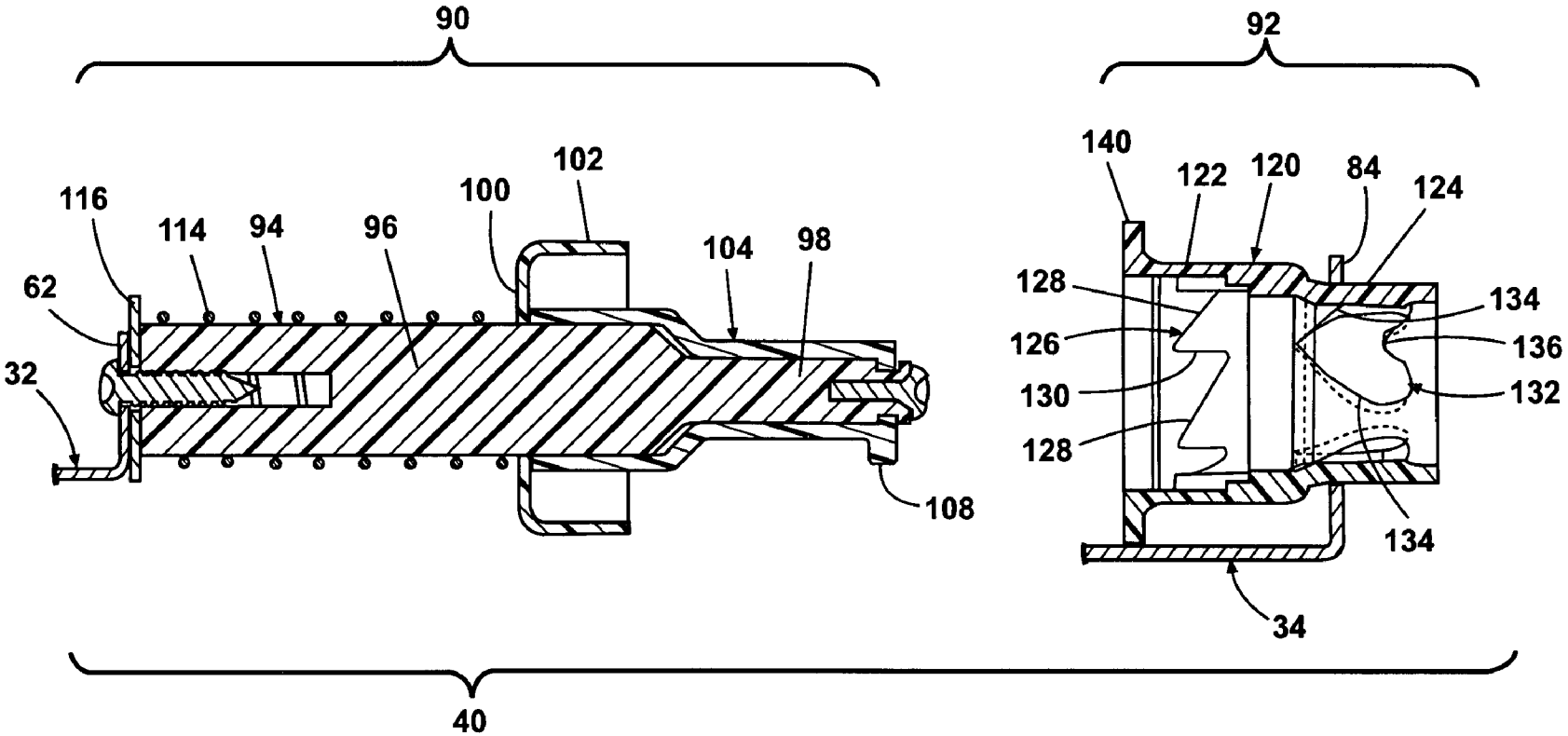
FIG. 7 is a sectional view taken along line 7-7 of FIG. 6.

The actuator 40, which is shown in an enlarged view in FIG. 6 and in a sectional view in FIG. 7, comprises a movable portion 90 mounted to the flange 62 on the slide 32 and a stationary portion 92 mounted to the flange 84 of the track 34. The movable portion 90 comprises a main body 94 that is generally cylindrical and has a larger diameter section 96 that tapers distally into a smaller diameter section 98. The larger diameter section 96 is slidingly received within a collar 100 having a distally extending side wall 102. A sleeve 104 surrounds the main body 94 distally of the collar 100 and includes a plurality of first and second cam followers 106, 108. The first cam followers 106 are circumferentially spaced around a proximal end of the sleeve 104. Each of the first cam followers 106 comprises a pair of longitudinal surfaces 110, wherein one of the longitudinal surfaces 110 is longer than the other, and the longitudinal surfaces 110 are joined by an inclined surface 112. The second cam followers 108 are knob-like radial projections circumferentially spaced around a distal end of the sleeve 104. The sleeve 104 can be coupled to the smaller diameter section 98 with any suitable means, such as by a mechanical fastener, and can rotate relative to the smaller diameter section 98. The movable portion 90 of the actuator 40 further comprises a biasing element 114, which is shown in the illustrated embodiment as a coil compression spring, disposed around the larger diameter section 96 of the main body 94 between the collar 100 and a washer 116 that extends radially beyond the main body 94 at a proximal end thereof. The movable portion 90 is secured to the flange 62 on the slide 32 with any suitable means, such as a mechanical fastener.

The stationary portion 92 of the actuator 40 comprises a hollow main body 120 having a larger diameter section 122 that tapers distally into a smaller diameter section 124. A first cam 126 formed on the interior of the larger diameter section 122 comprises a plurality of inclined surfaces 128 joined by a plurality of longitudinal surfaces 130. The quantity of the inclined surfaces 128 is equal to the quantity of the first cam followers 106. Similarly, a plurality of second cams 132 are formed on the interior of the smaller diameter section 124, and the number of the second cams 132 is equal to the number of the second cam followers 108. The second cams 132 are circumferentially spaced from one another, and each of the second cams 132 comprises a pair of opposed arcuate surfaces 134 that join to form a heart-shaped structure having a distal valley 136. The stationary portion 92 further includes an exterior annular shoulder 140 at a proximal end of the larger diameter section 122. The smaller diameter section 124 is received by the flange 84 of the track 34, with a distal end of the larger diameter section 122 abutting a proximal side of the flange 84.

An exemplary description of the assembly of the hanging element 12 follows. It will be apparent to one of ordinary skill that the assembly procedure can proceed in any logical order and is not limited to the sequence presented below. The following description is for illustrative purposes only and is not intended to limit the invention in any manner.

To assemble the hanging element 12, the stationary portion 92 of the actuator 40 is mounted to the flange 84 of the track 34, and the track 34 is fastened to the proximal and distal brackets 36. Next, the hanging rod 30 is mounted to the slide 32, such as through a fastener that extends through the aperture 60 of the slide 32 and into the mounting boss 52 of the hanging rod 30. In this manner, the proximal end 58 of the slide 32 is received within the hanging rod 30, and the slide 32 projects distally from the distal end 44 of the hanging rod 30. At the distal end 64 of the slide 32, the movable portion 90 of the actuator 40 is mounted to the flange 62 such that the movable portion 90 extends distally from the slide 32.

At this point, the hanging element 12 is assembled into two halves: a first half supported by the track 34 and a second half supported by the slide 32. The two halves are joined by inserting the side rails 56 at the distal end 64 of the slide 32 into the side rails 72 at the proximal end 78 of the track 34 and sliding the slide 32 onto the track 34. As the slide 32 slides along the track 34, the movable portion 90 of the actuator 40 enters the stationary portion 92 of the actuator 40, and the interaction between the first cams 126 and the first cam followers 106 and between the second cams 132 and the second cam followers 108 locks the hanging element 12 in the retracted position. The interaction between the cams 126, 132 and the respective cam followers 106, 108 will be described in more detail in the discussion of the operation of the hanging element 12.

The hanging element 12 can be mounted to the cabinet 14 via the proximal and distal brackets 36 at any suitable time during the assembly process. For example, the brackets 36, the track 34, and the stationary portion 92 of the actuator 40 can be mounted to the cabinet 14 before the slide 32 and the components supported thereby are coupled to the track 34. Another option is to mount the brackets 36, the track 34, and the stationary portion 92 of the actuator 40 to the cabinet 14, mount the hanging rod 30 to the slide 32 and couple the slide 32 to the track 34 by inserting the slide 32 and the hanging rod 30 through the opening 28, and then mount the movable portion 90 of the actuator 40 to the slide 32. Alternatively, the hanging element 12 can be completely assembled before the hanging element 12 is mounted to the cabinet 14.

An exemplary description of the operation of the hanging element 12 follows. It will be apparent to one of ordinary skill that the operation procedure can proceed in any logical order and is not limited to the sequence presented below. The following description is for illustrative purposes only and is not intended to limit the invention in any manner.

Figure 8:
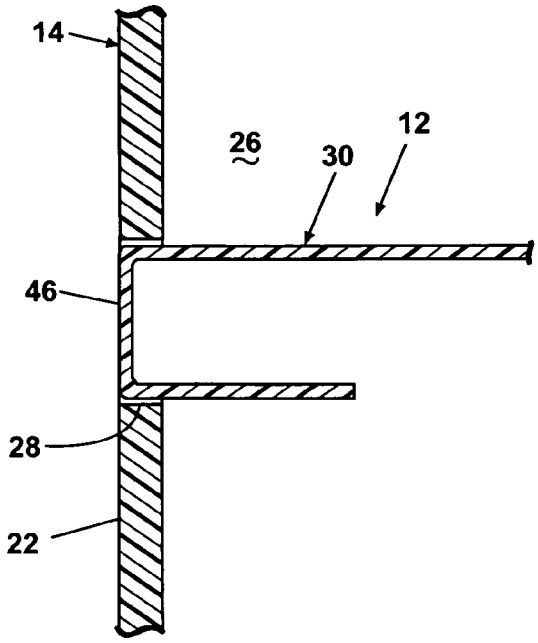
FIG. 8 is a schematic sectional view showing a proximal end of the hanging element of FIG. 3 flush with an outer surface of the household consumer product.
Figure 9:
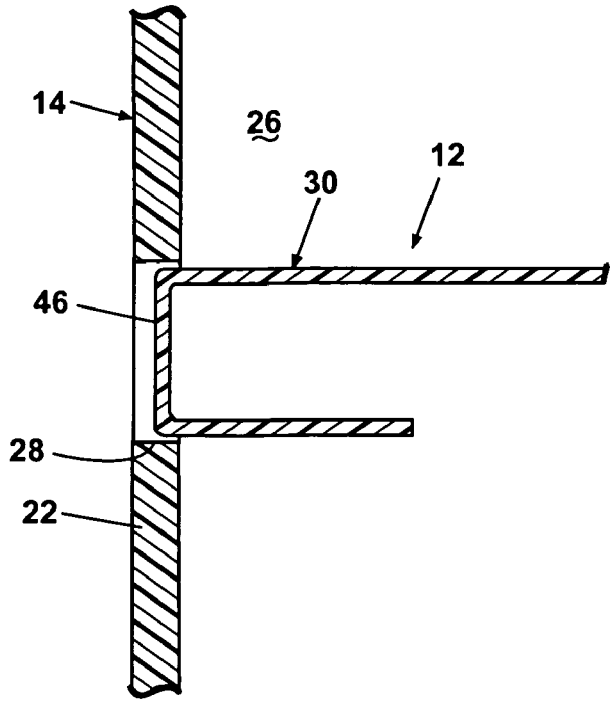
FIG. 9 is a schematic sectional view similar to FIG. 8, wherein the proximal end of the hanging element is positioned distally of the outer surface of the household consumer product.

When the hanging element 12 is in the retracted position, the hanging element 12 is received in the interior space 26 of the cabinet 14 and is positioned for sliding movement though the opening 28. In particular, the proximal end of the hanging element 12, which corresponds to the proximal end 46 of the hanging rod 30 in the illustrated embodiment, does not extend beyond the front wall 22 of the cabinet 14. In other words, the proximal end 46 can be flush with the outer surface of the front wall 22, as shown schematically in FIG. 8, or positioned distally relative to the outer surface of the front wall 22, as shown schematically in FIG. 9.

Figure 10:
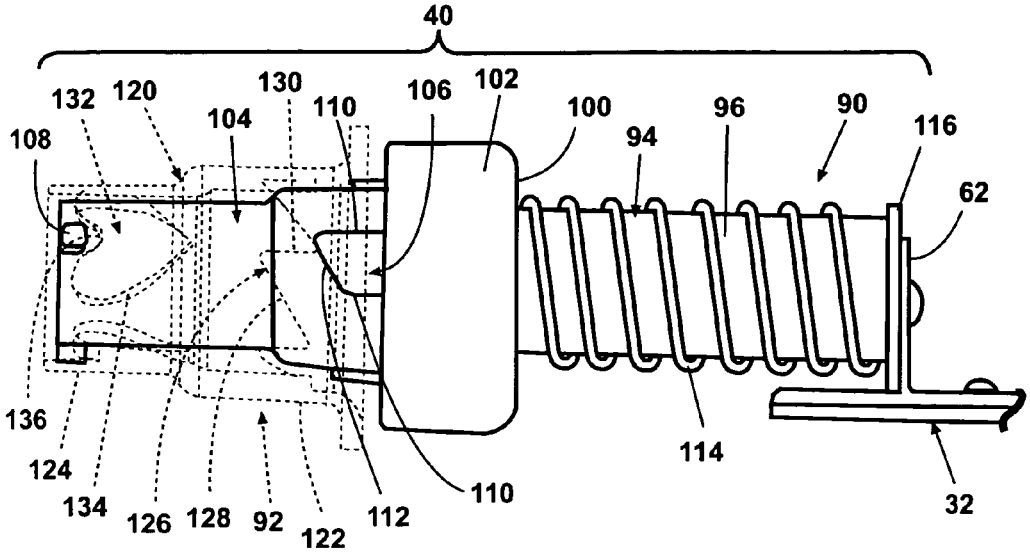
FIG. 10 is a perspective view of the actuator from the hanging element of FIG. 3 in a locked condition, wherein a stationary portion of the actuator is shown in phantom.

The hanging element 12 is retained in the retracted position by the actuator 40, which is in a locked condition illustrated in FIG. 10. In the locked condition, the second cam followers 108 on the movable portion 90 of the actuator 40 are received in the distal valleys 136 of the second cams 132, thereby preventing proximal movement of the movable portion 90 of the actuator 40. Additionally, the biasing element 114 is a slightly compressed state when the actuator 40 is in the locked condition to apply a proximal force to the washer 116 and thereby the movable portion 90 to retain the second cam followers 108 in the distal valleys 136.

Figure 11:
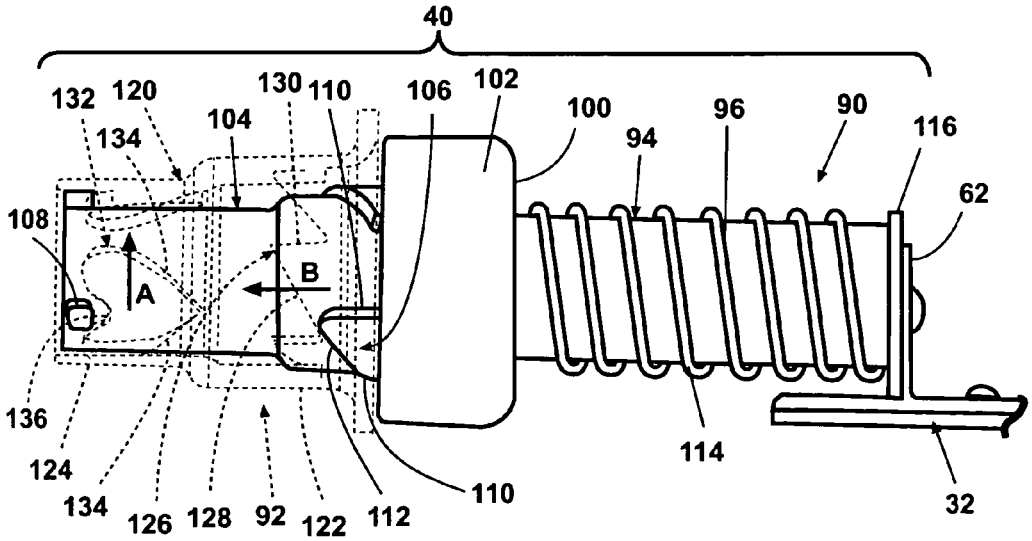
FIGS. 11-13 are perspective views similar to FIG. 10 showing an operation of unlocking the actuator to move the hanging element from the retracted position.

To unlock the actuator 40 so that the hanging element 12 can be displaced proximally through the opening 28, a user applies a distal force to the hanging rod 30. As a result, the slide 32 slides distally along the track 34, and the moveable portion 90 of the actuator 40 moves distally within the stationary portion 92 of the actuator 40. As the moveable portion 90 moves distally, the second cam followers 108 leave the respective distal valleys 136 and move distally of the second cams 132, as shown in FIG. 11. When the second cam followers 108 reach the position in FIG. 11, the collar side wall 102 abuts the shoulder 140 on the stationary portion 92 of the actuator 40, thereby preventing further distal movement of the collar 100.

Figure 12:
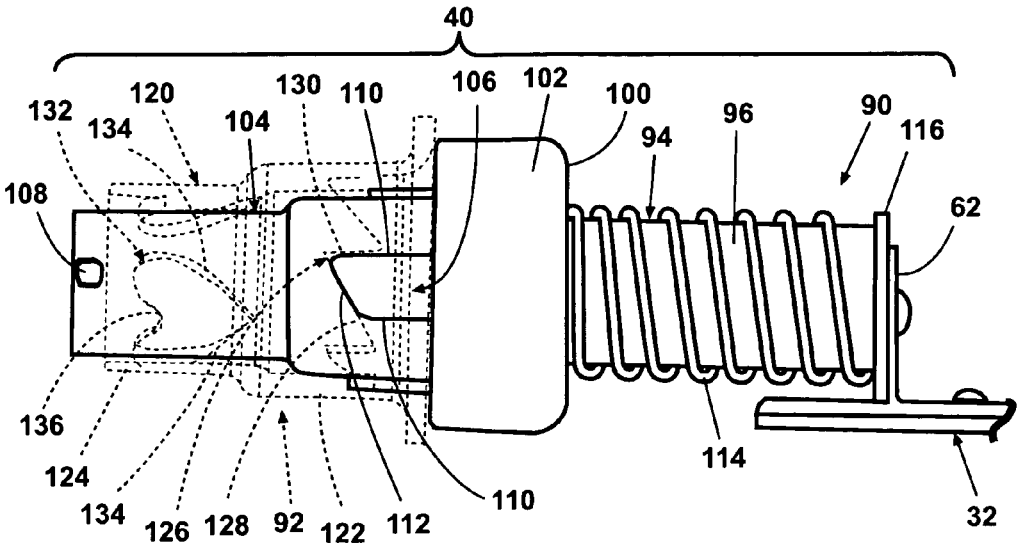

Continued distal force on the hanging element 12, however, forces the slide 32 to push the washer 116, the main body 94, and the sleeve 104 distally while the collar 100 remains stationary. As a result, the first cam followers 108 move distally and engage the first cams 126. In particular, the inclined surfaces 112 on the first cam followers 106 abut the inclined surfaces 128 on the first cam 126. Because these surfaces 112, 128 are inclined, the interaction therebetween forces the sleeve 104 to rotate relative to the main body 94 of the moveable portion 90 as the washer 116, the main body 94, and the sleeve 104 move distally, as indicated by arrows A and B, respectively, in FIG. 11. This combined distal and rotational motion continues until the longer of the longitudinal surfaces 110 on the first cam followers 106 abut the longitudinal surfaces 130 of the first cams 126, as shown in FIG. 12. By the time the actuator 40 reaches the condition shown in FIG. 12, the sleeve 104 has rotated an amount sufficient to rotate the second cam followers 108 to a position where each of the second cam followers 108 is longitudinally aligned with one of the arcuate surfaces 134 of the corresponding second cam 132. Additionally, as the washer 116, the main body 94, and the sleeve 104 move distally while the sleeve 104 rotates to the position shown in FIG. 12, the biasing element 114 compresses further between the washer 116 and the stationary collar 100.

Figure 13:
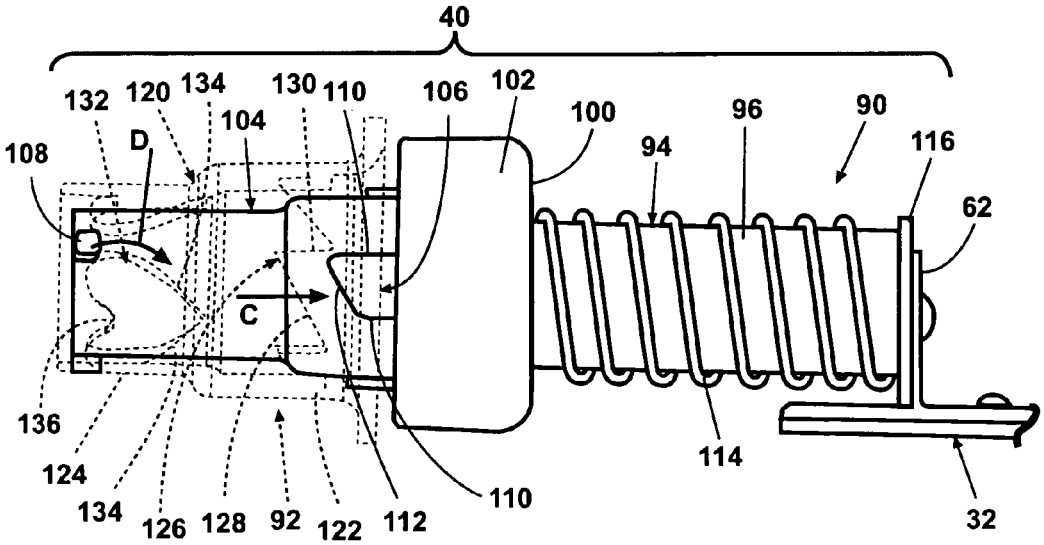

Once the actuator 40 reaches the condition shown in FIG. 12, the interaction between the longitudinal surfaces 110, 130 prevents further rotation of the sleeve 104, further distal movement of the washer 116, the main body 94, and the sleeve 104, and further compression of the biasing element 114. Next, the user releases the distal force applied to the hanging element 12, thereby releasing the biasing element 114, which expands and pushes the washer 116, the main body 92, and the sleeve 104 proximally, as indicated by arrow C, while the collar 100 remains stationary. As shown in FIG. 13, the second cam followers 108 ride along the corresponding arcuate surfaces 134 of the second cams 132, as indicated by arrow D, as the sleeve 104 moves distally within the stationary portion 92 of the actuator 40. The proximal movement of the movable portion 90 of the actuator 40, except for the collar 100, continues until the sleeve 104 abuts the collar 100, at which time, the biasing element 114 cannot expand any further. During this proximal movement, the movable portion 90 of the actuator 40 forces the slide 32 and the hanging rod 30 to slide proximally toward and through the opening 28 to move the hanging element 12 to the extended condition.

Figure 15:
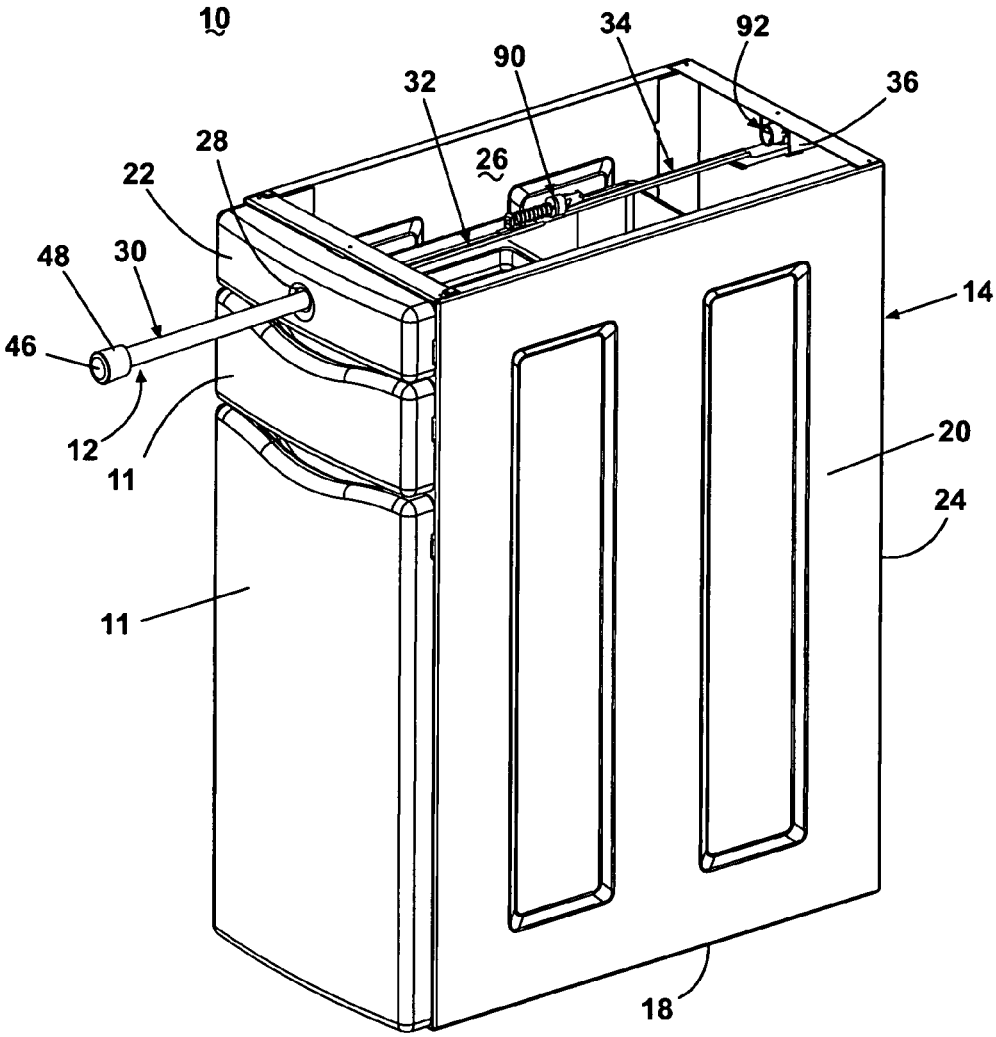
FIG. 15 is a perspective view similar to FIG. 3, wherein the hanging element has been pulled from the extended position of FIG. 14 to a fully extended position.
Figure 16:
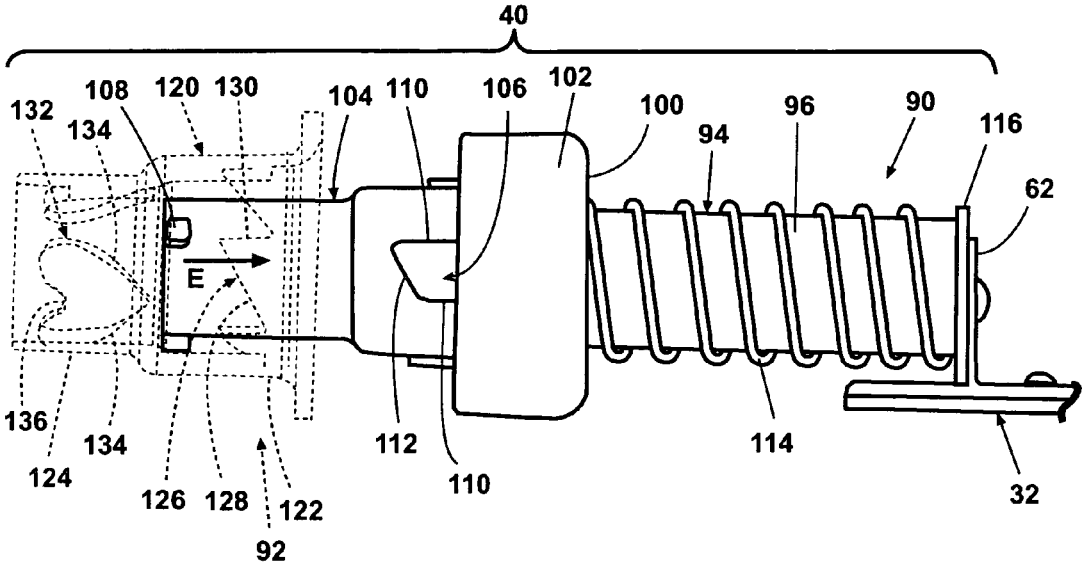
FIG. 16 is a perspective view similar to FIG. 10 showing movement of a movable portion of the actuator relative to the stationary portion of the actuator while moving the hanging element to the fully extended position of FIG. 15.

When the hanging element 12 is in the extended position, the proximal end of the hanging element 12, which corresponds to the proximal end 46 of the hanging rod 30 in the illustrated embodiment, extends beyond the front wall 22 of the cabinet 14. In particular, the proximal end 46 extends beyond the outer surface of the front wall 22, as shown schematically in FIG. 14. Because the hanging element 12 extends beyond the front wall 22 in the extended position, the user can grasp and pull the hanging rod 30 to slide the hanging element 12 further through the opening 28 to a fully extended position, as illustrated in FIG. 15, so that clothing items can be hung from the hanging rod 30. As the hanging rod 30 is pulled through the opening 28, the entire movable portion 90 of the actuator 40 moves proximally with the hanging rod 30 and the slide 32 and away from the stationary portion 92, as shown by arrow E in FIG. 16. The hanging element 12 can include a stop to limit the extent to which the hanging element 12 extends beyond the front wall 22 when fully extended.

Figure 14:
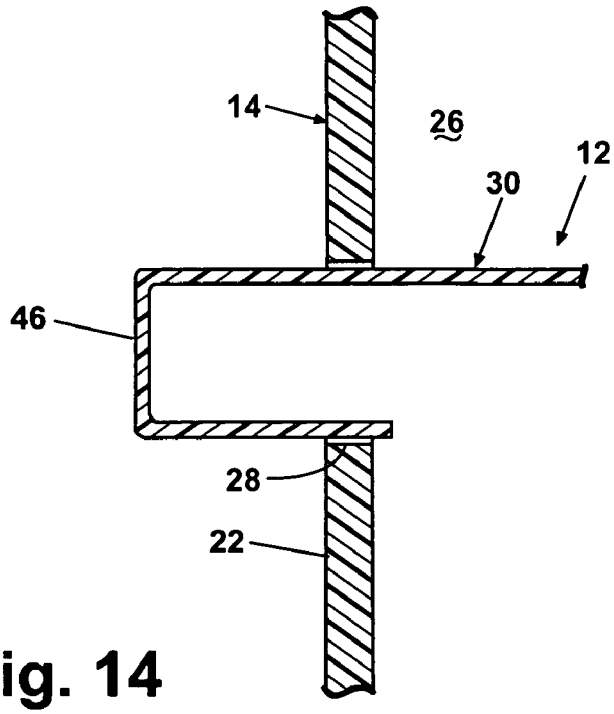
FIG. 14 is a schematic sectional view similar to FIGS. 8 and 9, wherein the hanging element is in the extended position with the proximal end of the hanging element extending beyond the outer surface of the household consumer product.
Figure 17:
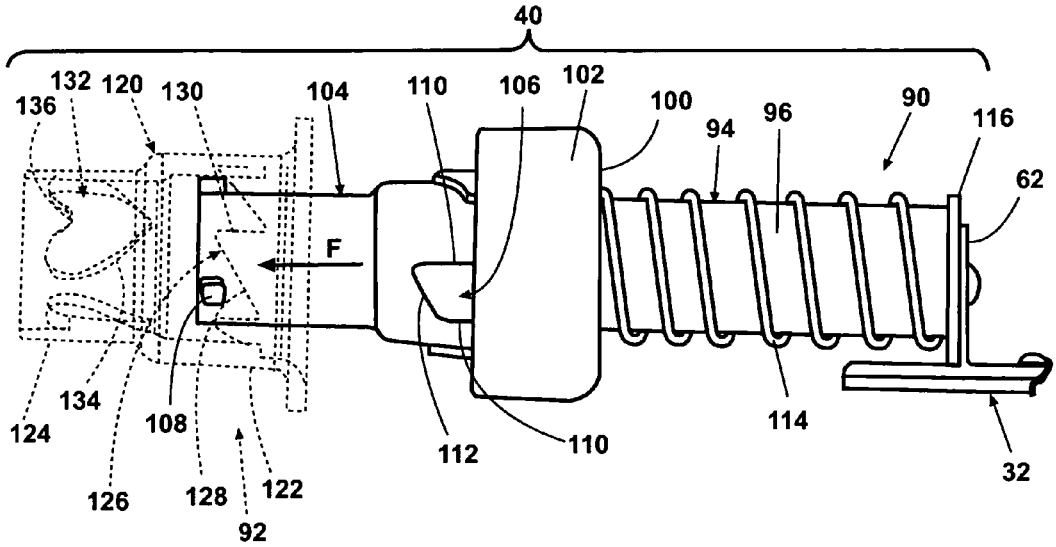
FIGS. 17-20 are perspective views similar to FIG. 10 showing an operation of locking the actuator to secure the hanging element in the retracted position.
Figure 18:
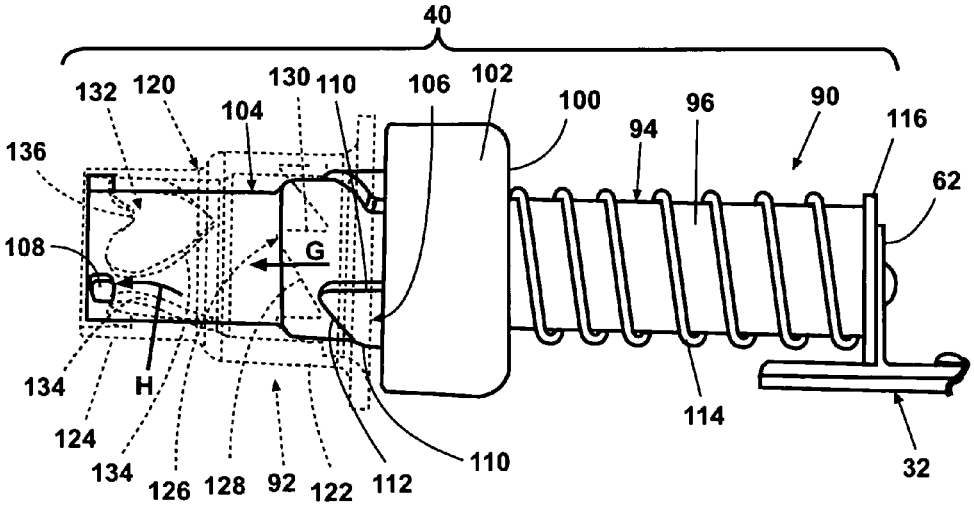

To return the hanging element 12 to the retracted position, the user pushes the hanging rod 30 distally until it reaches the extended position shown schematically in FIG. 14. The user continues to apply a distal force to the hanging rod 30 so that the slide 32 slides along the track 34 to insert the movable portion 90 of the actuator 40 into the stationary portion 92 of the actuator 40, as depicted by arrow F in FIG. 17. Referring now to FIG. 18, as the movable portion 90 moves distally within the stationary portion 92, as indicated by arrow G, the second cam followers 108 ride along the corresponding arcuate surfaces 134 of the second cams 132, as indicated by arrow H, and move distally beyond the second cams 132 until the inclined surfaces 112 of the first cam followers 106 abut the inclined surfaces 128 of the first cams 126, at which point, the collar side wall 102 abuts the shoulder 140.

Figure 19:
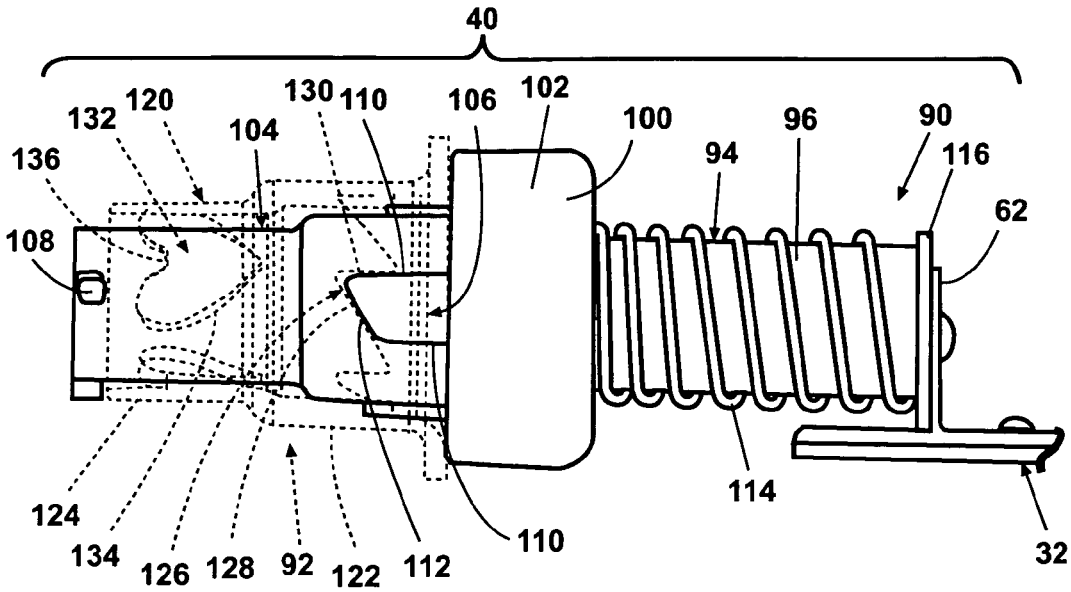
Figure 20:
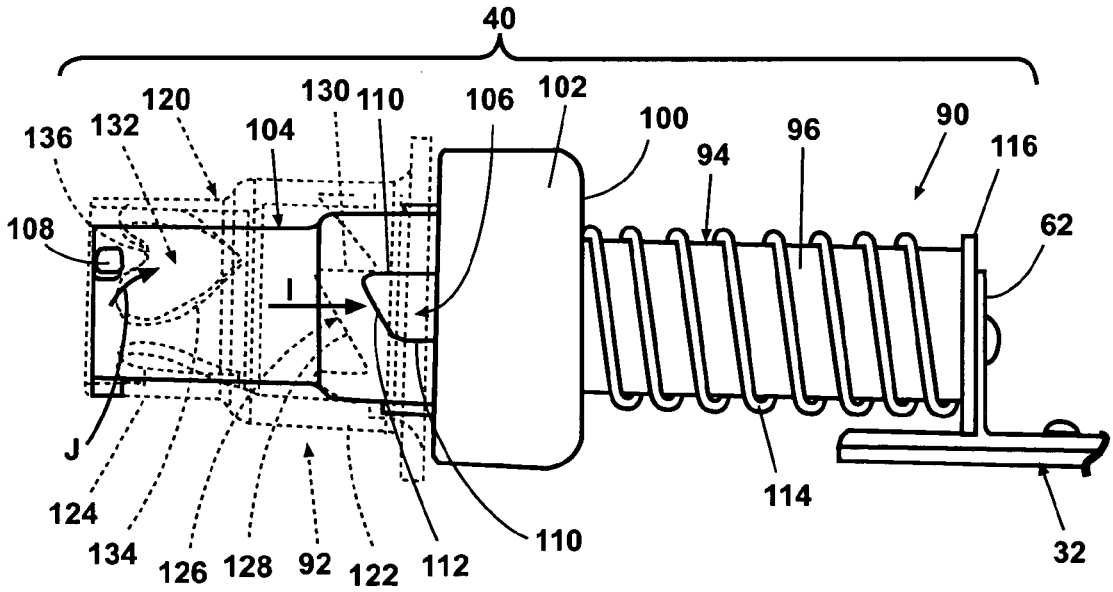

Continued force on the hanging rod 30 causes the washer 116, the main body 94, and the sleeve 104 to continue to move distally while the sleeve 104 rotates and the biasing element 114 compresses against the collar 100. When the sleeve 104 stops rotating due to interaction between the longitudinal surfaces 110 of the first cam followers 106 and the longitudinal surfaces 130 of the first cams 126, each of the second cam followers 108 is slightly offset from the corresponding distal valley 136, as illustrated in FIG. 19. Next, the user ceases application of the distal force to the hanging rod 30, which releases the biasing element 114. As the biasing element 114 expands, the biasing element 114 pushes the washer 116 and thereby the main body 94 and the sleeve 104 proximally, as indicated by arrow I in FIG. 20. As a result, the second cam followers 108 ride along the arcuate surfaces 134, as shown by arrow J, into the corresponding distal valleys 136 to place the actuator 40 in the locked condition of FIG. 10 and lock the hanging element 12 in the retracted position.

Another embodiment of a hanging element 12 is illustrated in FIGS. 21-24, where components similar to those of the previous embodiment of the hanging element 12 are identified with the same reference numeral. The hanging element 12 in FIGS. 21-24 is mounted to a household consumer product 10 in the form of an apparel drying module, which is described in further detail in the aforementioned and incorporated modular laundry system and vertical laundry module patent applications.

Figure 21:
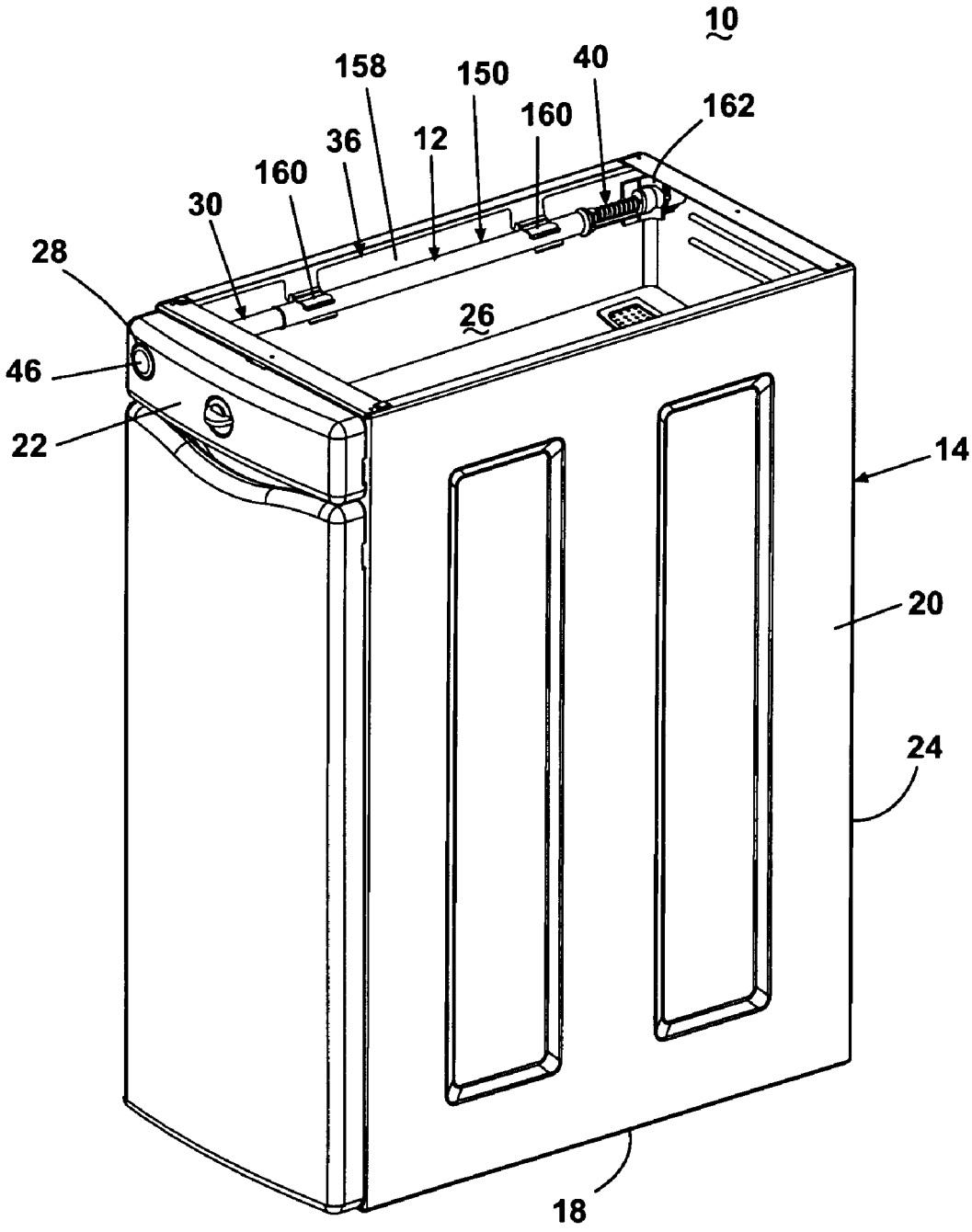
FIG. 21 is a perspective view of a household consumer product in the form of a drying module with a top wall removed and having a hanging element according to another embodiment of the invention, wherein the hanging element is shown in the retracted position.
Figure 22:
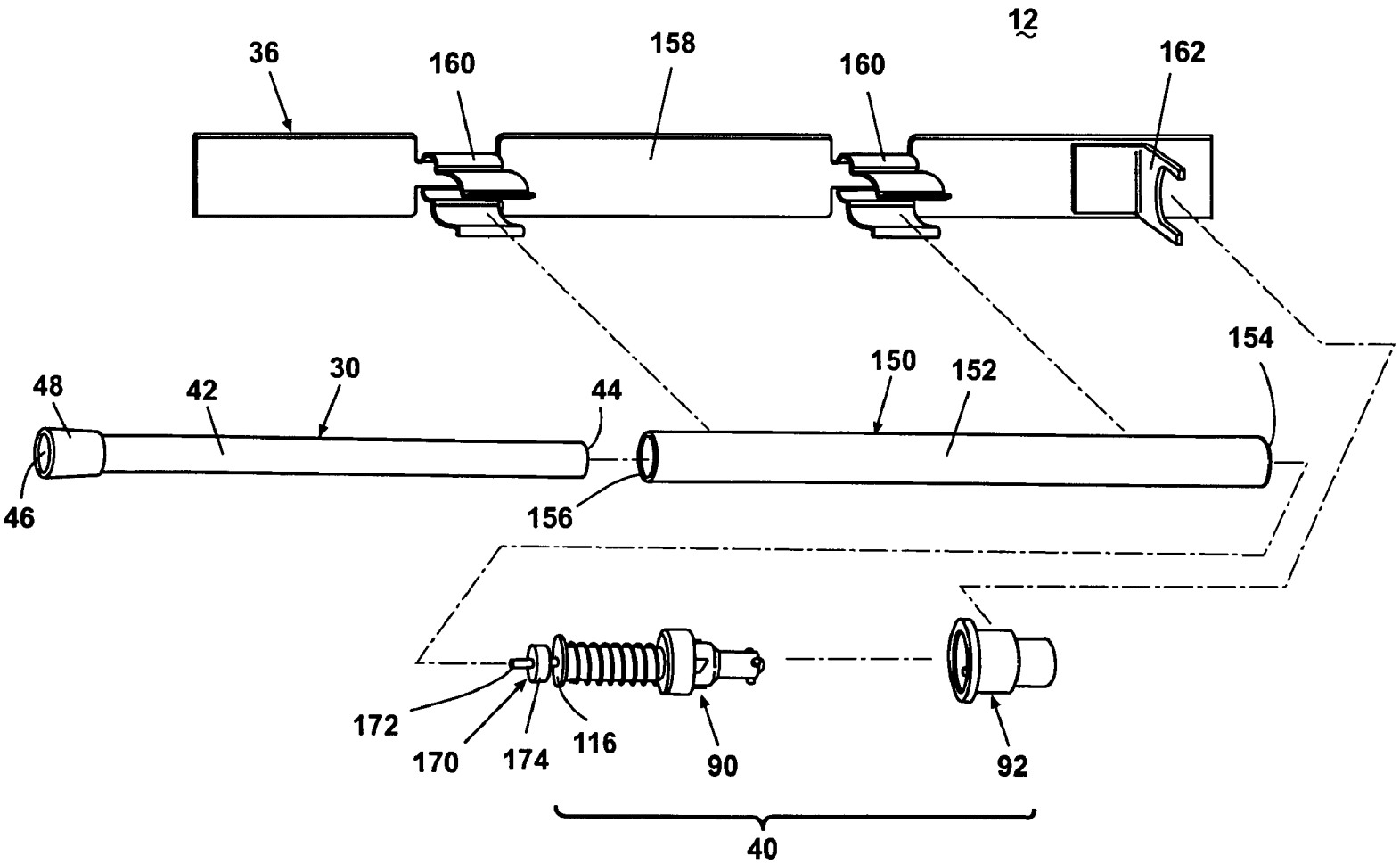
FIG. 22 is an exploded view of the hanging element of FIG. 21.
Figure 23:
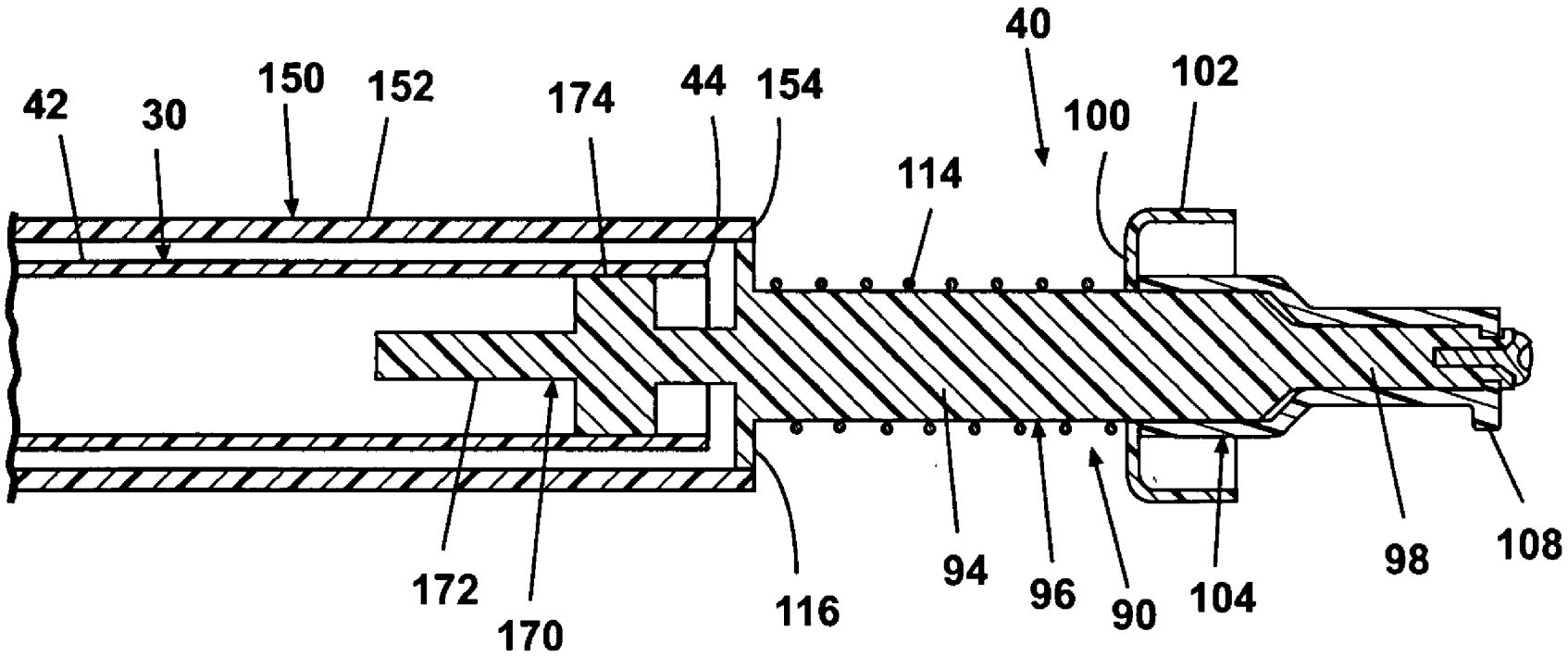
FIG. 23 is a sectional view of a portion of the hanging element of FIG. 21.
Figure 24:
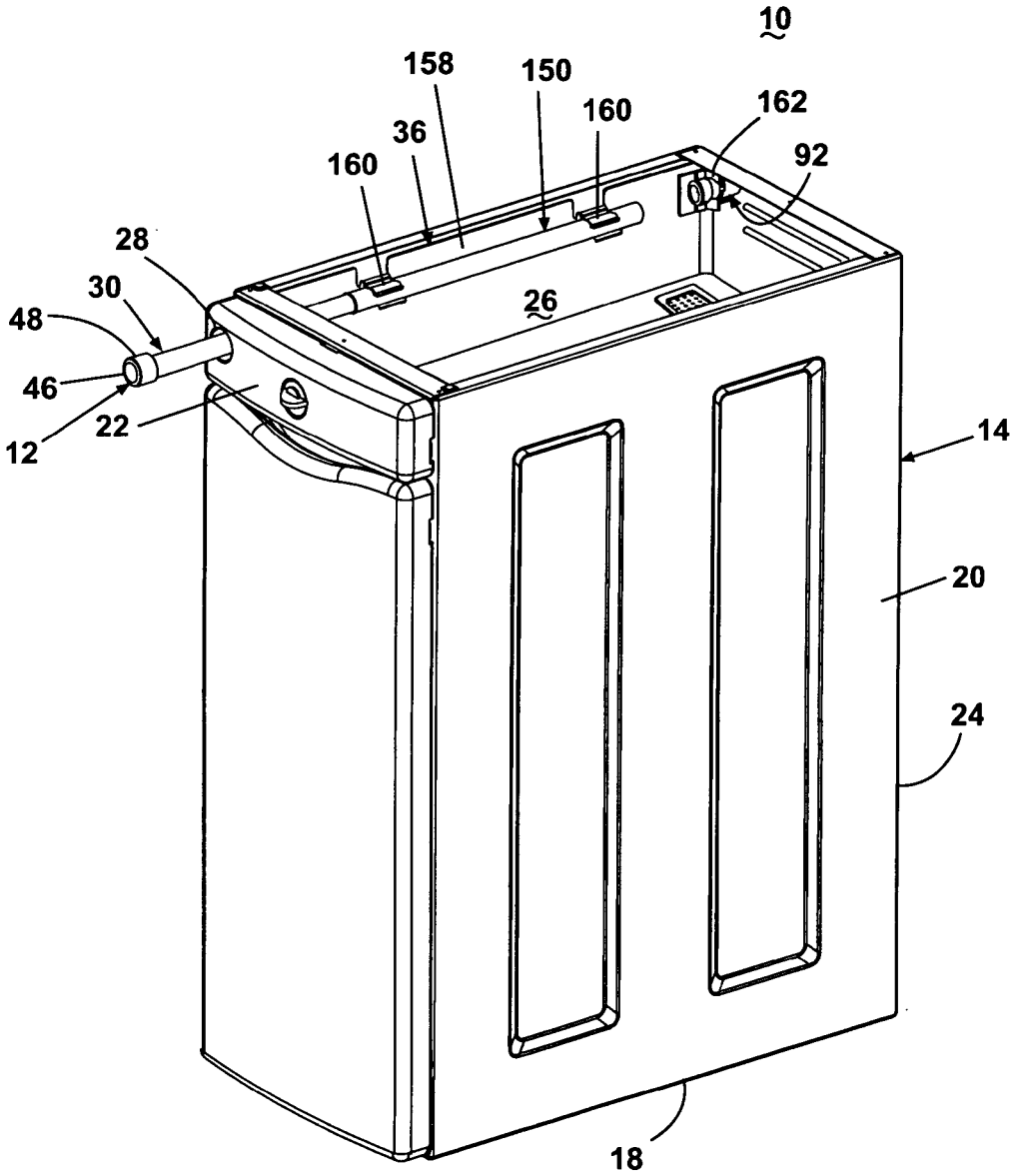
FIG. 24 is a perspective view similar to FIG. 21, wherein the hanging element is shown in the extended position.

Referring to FIGS. 21-23, the hanging element 12 comprises a hollow hanging rod 30 slidably received within a hollow, stationary guide tube 150 supported by a bracket 36 mounted to the cabinet 14. An actuator 40 partially mounted to the hanging rod 30 and partially supported by the bracket 36 facilitates movement of the hanging element 12 from the retracted position toward the extended position.

The hanging rod 30 comprises a hollow, generally cylindrical body 42 open a distal end 44 and closed at a proximal end 46 by a cap 48. The hanging rod 30 can have any suitable length, and the hanging rod 30 in the illustrated embodiment has a length slightly less than the depth of the cabinet 14.

The guide tube 150 also comprises a hollow, generally cylindrical body 152. The body 152 of the guide tube 150 is open at distal and proximal ends 154, 156 and has an internal diameter at least slightly greater than an outer diameter of the hanging rod 30 so that the hanging rod 30 is slidable within the guide tube 150.

The bracket 36 comprises a support panel 158 and spaced resilient clips 160 projecting from the support panel 158 and sized to receive the guide tube 150 to mount the guide tube 150 to the bracket 36. At a distal end, the bracket 36 includes an actuator support 162 that supports a portion of the actuator 40.

The actuator 40 is substantially identical to the actuator 40 described above with respect to the previous embodiment. The stationary portion 92 of the actuator 40 is mounted to the actuator support 162 on the bracket 36, and the movable portion 90 is coupled to the distal end 44 of the hanging rod 30 through an actuator mount 170 integrally formed with the washer 116, which is integrally formed with the main body 94 of the movable portion 90, as best viewed in FIG. 23. The actuator mount 170 comprises a central shaft 172 that terminates distally at the washer 116 and includes an annular disc 174 positioned proximally of the washer 116 on the shaft 172. The disc 174 has an outer diameter sized to form a friction fit with an inner surface of the hanging bar 30 to mount the disc 174 and thereby the actuator mount 170 in the hanging rod 30 at the distal end 44. The outer diameter of the washer 116 is greater than the inner diameter of the hanging rod 30 but less than the inner diameter of the guide tube 150. As a result, the washer 116 limits the extent to which the actuator mount 170 can fit within the hanging rod 30 at the distal end 44 yet can slide within the guide tube 150 with the hanging rod 30. The actuator mount 170 can alternatively be formed as a separate part and coupled to the actuator 40 in any suitable manner, such as with mechanical fasteners.

The hanging element 12 can be assembled in any suitable fashion, an example of which is provided below. The following assembly description is presented for illustrative purposes only and is not intended to limit the invention in any manner.

To assemble the hanging element 12, the stationary portion 92 of the actuator 40 is mounted to the actuator support 162 on the bracket 36, and the movable portion 90 is mounted to the hanging rod 30 by inserting the actuator mount 170 into the distal end 44 of the hanging rod 30. The cap 48 is placed on the proximal end 46 of the hanging rod 30, and the hanging rod 30 is slid into the proximal end 156 of the guide tube 150. The guide tube 50 with the hanging rod 30 slidably mounted therein is snapped into the clips 160 to mount the guide tube 150, the hanging rod 30, and the movable portion 90 of the actuator 40 to the bracket 36. The hanging element 12 can be mounted to the cabinet 14 via the bracket 36 at any suitable time during the assembly process.

The operation of the hanging element 12 is effectively identical to the operation described above with respect to the previous embodiment of the hanging element 12. In general, the user applies a distal force to the cap 48 so that the biasing element 114 of the actuator 40 moves the hanging element 12 from the retracted position of FIG. 21 toward the extended position of FIG. 24. Once the hanging element 12 is in the extended position, the user can pull the hanging rod 30 proximally to fully extend the hanging element 12. Again, the hanging element 12 can include a stop to limit the proximal movement of the hanging rod 30. To return the hanging element 12 to the retracted position, the user pushes the hanging rod 30 distally from the fully extended position to the extended position of FIG. 24 and continues to apply a distal force to the cap 48 to move the actuator 40 to the locked condition and thereby secure the hanging element 12 in the retracted position of FIG. 21.

Figure 26:
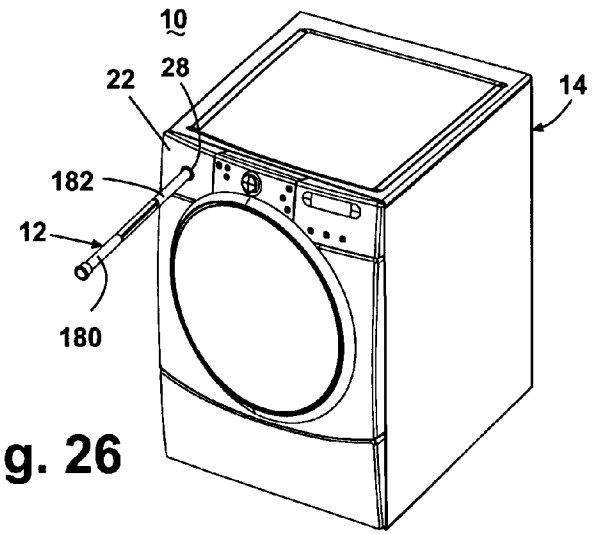
FIG. 26 is a perspective view similar to FIG. 25, wherein the hanging element is shown in the extended position.
Figure 25:
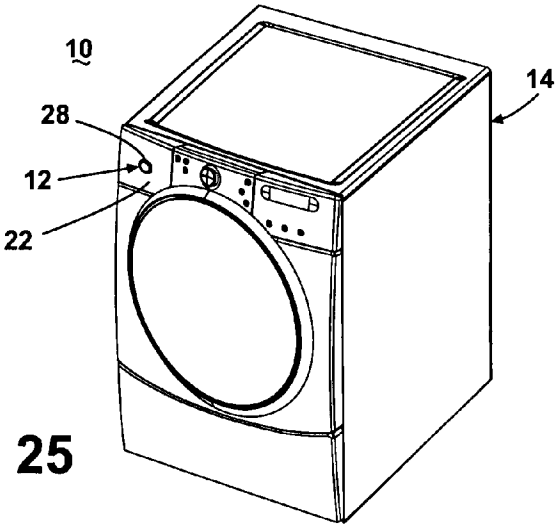
FIG. 25 is a perspective view of a household consumer product in the form of a laundry appliance having a hanging element according to another embodiment of the invention, wherein the hanging element is shown in the retracted position.
Figure 27:
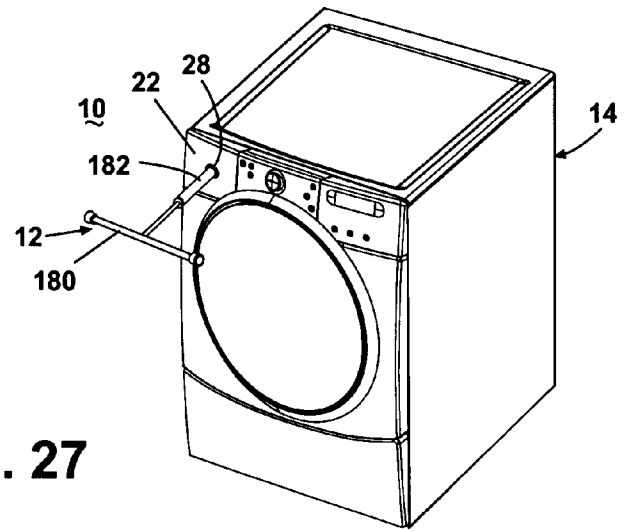
FIG. 27 is a perspective view similar to FIG. 26, wherein a proximal portion of the hanging element is pivoted to a generally perpendicular orientation relative to a distal portion of the hanging element.

Another alternative embodiment of a hanging element 12 is illustrated in FIGS. 25-27, where components similar to those of the previous embodiments of the hanging element 12 are identified with the same reference numeral. The hanging element 12 in FIGS. 25-27 is mounted to a household consumer product 10 in the form of a laundry appliance, in particular a clothes dryer.

The hanging element 12, which is movable from the retracted position of FIG. 25 to the extended position of FIG. 26, is similar to the hanging element 12 shown in FIGS. 21-24, except that the hanging rod 30 comprises a proximal portion 180 pivotally mounted to a distal portion 182. As a result, when the hanging element 12 is in the extended position of FIG. 26, the proximal portion 180 can optionally be pivoted from an orientation generally colinear with the distal portion 182 to an orientation substantially perpendicular to the distal portion 182, as illustrated in FIG. 27. When the hanging rod 30 is oriented as shown in FIG. 27, clothing items can be hung along the entire length of the proximal portion 180 as well as along the distal portion 182.

Other alternative hanging rods 30 for the hanging element 12 are illustrated in FIGS. 28-31, where components similar to those of the previous embodiments of the hanging element 12 are identified with the same reference numeral. In each of these embodiments, the hanging rod 12 is mounted to a household consumer product 10 in the form of a storage module, similar to that shown with respect to the embodiment of FIGS. 3-20.

Figure 29:
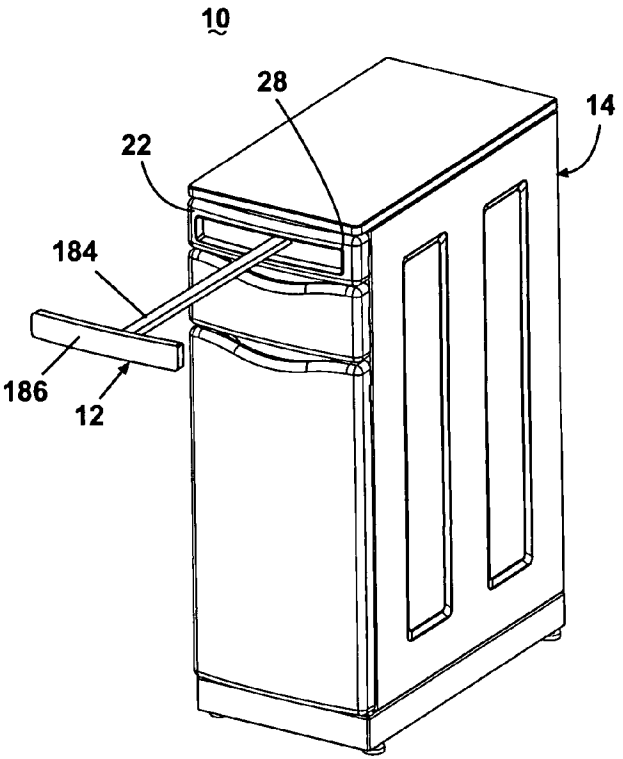
FIG. 29 is a perspective view similar to FIG. 28, wherein the hanging element is shown in the extended position.
Figure 28:
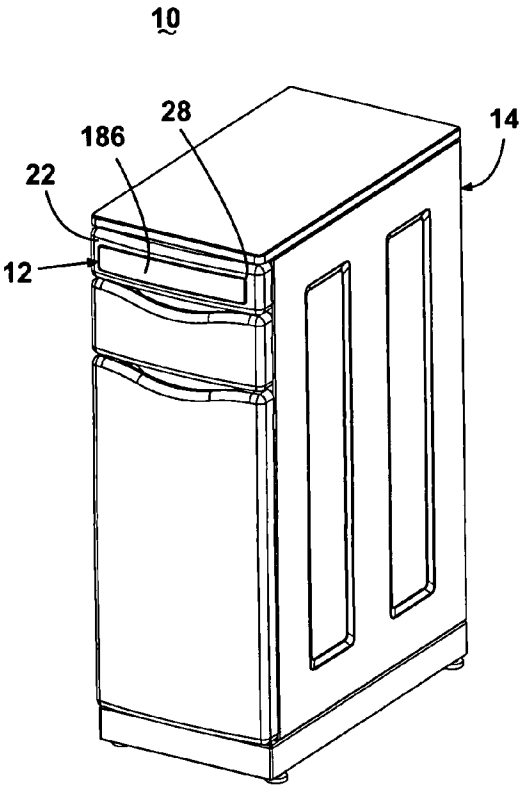
FIG. 28 is a perspective view of a household consumer product in the form of a storage module having a hanging element according to another embodiment of the invention, wherein the hanging element is shown in the retracted position.

Referring now to FIGS. 28 and 29, the hanging rod 30 is in the form of a T-shaped bar having a stem 184 and a crossbar 186. When the hanging element 12 is in the retracted position, the crossbar 186 of the hanging rod 30 is flush with the outer surface 22A of the cabinet front wall 22, as shown in FIG. 28, or is positioned distally of the front wall outer surface 22A. When the hanging element 12 is in the extended position, which is illustrated in FIG. 29, the crossbar 186 extends beyond the front wall outer surface 22A, and clothing items can be hung along the entire length of the crossbar 186 as well as along the stem 184.

Figure 31:
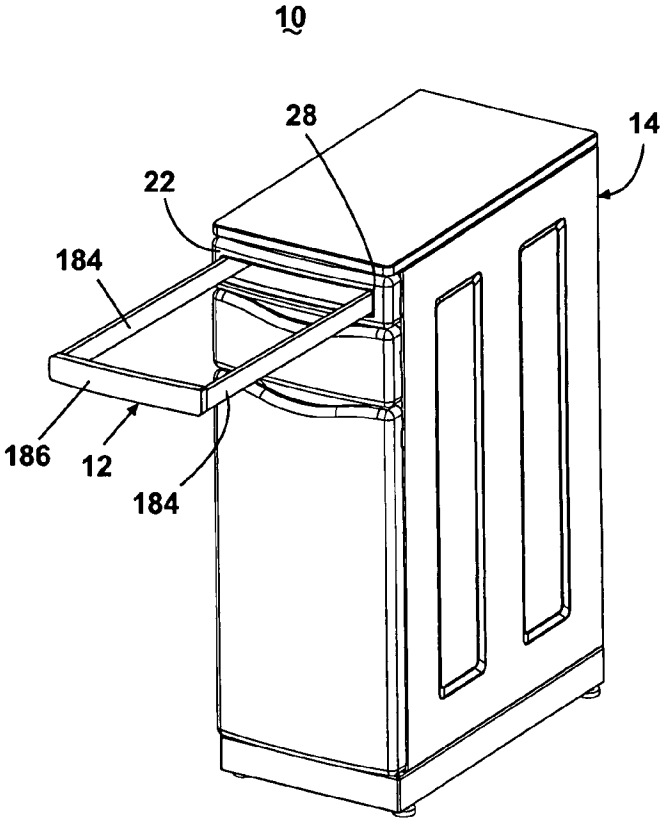
FIG. 31 is a perspective view similar to FIG. 30, wherein the hanging element is shown in the extended position.
Figure 30:
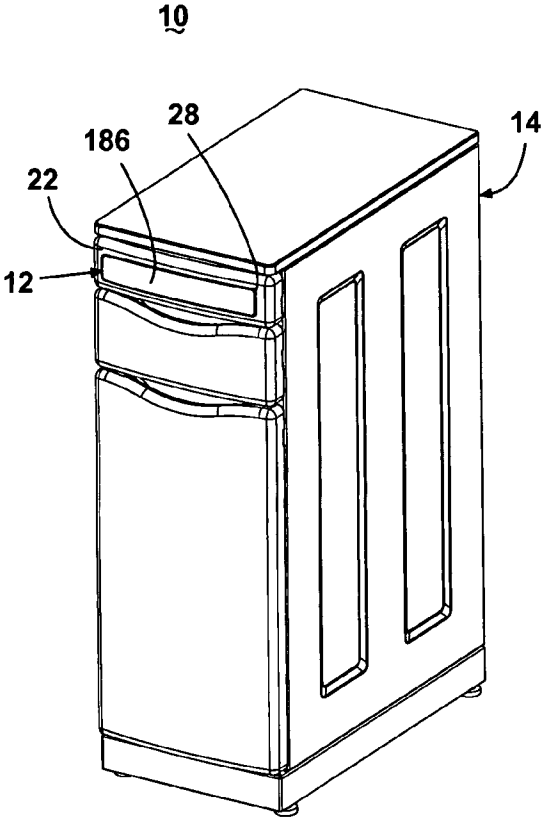
FIG. 30 is a perspective view of a household consumer product in the form of a storage module having a hanging element according to another embodiment of the invention, wherein the hanging element is shown in the retracted position.

Referring now to FIGS. 30 and 31, the hanging rod 30 is in the form of a U-shaped bar having a pair of stems 184 joined at their proximal ends by a crossbar 186. When the hanging element 12 is in the retracted position, the crossbar 186 of the hanging rod 30 is flush with the outer surface of the cabinet front wall 22, as shown in FIG. 30, or positioned distally of the outer surface of the front wall 22. When the hanging element 12 is in the extended position, which is illustrated in FIG. 31, the crossbar 186 extends beyond the outer surface of the front wall 22, and clothing items can be hung along the entire length of the crossbar 186 as well as along the stems 184.

The hanging rods 30 described above and shown in the figures are provided for illustrative purposes, and it is within the scope of the invention to utilize other types of hanging rods. Similarly, the actuator 40 described above and shown in the figures is a particular type of a push-push actuator and is provided for illustrative purposes. It is within the scope of the invention to utilize other types of push-push actuators and other types of actuators that allow the hanging element 12 to move from the retracted position, wherein the proximal end of the hanging element 12 is flush with or positioned distally of the peripheral wall of the cabinet 14, toward the extended position, wherein the proximal end of the hanging element 12 extends proximally of the peripheral wall of the cabinet 14. Furthermore, the embodiments the hanging element 12 presented above are all shown as extending through the opening 28 in the front wall 22 of the cabinet 14; however, the opening 28 can be located in any wall of the cabinet 14 and is most preferably in the peripheral wall of the cabinet 14. Thus, the hanging element 12 can extend from any wall of the cabinet 14.

The inventive hanging element 12 provides several advantages over prior art hanging elements. For example, because the hanging element 12 includes the actuator 40 with the biasing element 114 for biasing the hanging element 12 from the retracted position toward the extended position, the proximal end of the hanging element 12 can be positioned flush with or distally relative to the outer surface of the cabinet 14 when in the retracted position. Not only does this allow the hanging element 12, when not in use, to provide an aesthetically pleasing appearance to the household consumer product in which it is mounted, but also the user cannot accidentally bump into the hanging element 12 when it is in the retracted position.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household consumer product comprising:

a cabinet having a peripheral wall that partially defines an interior space for the cabinet and includes an opening that provides access to the interior space;

a track mounted to the cabinet and located in the interior space, and having a distal mount;

a hanging rod having a slide coupled to the track for movement through the opening between a fully extended position, where an end of the hanging rod extends exteriorly beyond the peripheral wall, and a retracted position, where the end does not extend exteriorly beyond the peripheral wall; and an actuator operable between a locked condition and an unlocked condition and comprises a stationary portion fixed to the distal mount and having a first cam, a movable portion carried by the slide and having a first cam follower, and a biasing element carried by the movable portion;

wherein, when the end of the hanging rod is depressed toward the interior space from the retracted position, the first cam follower moves relative to the first cam to change the state of the actuator from the locked condition to the unlocked condition and the biasing element is released from a compressed state and biases the slide along the track to move the end of the hanging rod to an intermediate position between the retracted and fully extended positions in which the hanging rod is accessible to a user to manually move the slide further along the track to move the hanging rod to the fully extended position.

2. The household consumer product according to claim 1, wherein the end of the hanging rod is flush with the peripheral wall when in the retracted position.

3. The household consumer product according to claim 1, wherein the peripheral wall has an outer surface, and when the hanging rod is in the retracted position, the end of the hanging rod is one of flush with the peripheral wall outer surface and positioned interiorly of the peripheral wall outer surface.

4. The household consumer product according to claim 1, wherein the biasing element is a spring.

5. The household consumer product according to claim 1, wherein the actuator is a push-push actuator.

6. The household consumer product according to claim 1, wherein the peripheral wall comprises a front wall, and the opening is formed in the front wall.

7. The household consumer product according to claim 1, wherein the hanging rod comprises a distal portion and a proximal portion pivotally mounted to the distal portion.

8. The household consumer product according to claim 1, wherein the hanging rod comprises at least one of a U-shaped bar and a T-shaped bar.

9. The household consumer product according to claim 1, wherein the household consumer product is a laundry appliance.

10. The household consumer product according to claim 1, wherein the stationary portion comprises a second cam and the movable portion comprises a second cam follower, wherein the second cam follower is received by the second cam in the locked condition, thereby preventing movement of the hanging rod to the intermediate position.

11. The household consumer product according to claim 1, wherein the hanging rod is carried by the slide.

12. The household consumer product according to claim 1, wherein the slide comprises at least one rail and the track comprises at least one rail slidingly received by the at least one rail of the slide.

13. The household consumer product according to claim 1, wherein the track comprises a guide tube.

14. The household consumer product according to claim 13, wherein the hanging rod and the slide comprise a single body slidably received within the guide tube.

15. The household consumer product according to claim 1, wherein the movable portion is completely decoupled from the stationary portion in the unlocked condition.

16. The household consumer product according to claim 1, wherein the distal mount comprises a flange extending from the track and the stationary portion is supported by the flange.

* * * * *